US005910023A

United States Patent [19]

McHugh et al.

[11] Patent Number: 5,910,023

[45] Date of Patent: Jun. 8, 1999

[54] HOLDING DEVICE FOR MOUNTING CONNECTOR ON BOARD

[75] Inventors: Robert G. McHugh, Evergreen, Colo.; Yu-Ming Ho, Pen-Chiao; Ming-Chuan Wu, Taipei Hsien, both of Taiwan

[73] Assignee: Hon Hai Precision Ind. Co., Ltd., Taipei Hsien, Taiwan

[21] Appl. No.: 08/890,581

[22] Filed: Jul. 9, 1997

[51] Int. Cl.[6] ..... H01R 13/60

[52] U.S. Cl. ..... 439/41

[58] Field of Search ..... 439/41, 940, 135, 439/148, 149, 150

[56] References Cited

U.S. PATENT DOCUMENTS

| | | | |
|---|---|---|---|
| 4,396,245 | 8/1983 | Lane | 439/148 |
| 5,026,295 | 6/1991 | Fong et al. | 439/940 |
| 5,242,311 | 9/1993 | Seong | 439/940 |
| 5,249,977 | 10/1993 | Tanaka et al. | 439/940 |
| 5,361,492 | 11/1994 | Miyazawa | 439/940 |
| 5,507,657 | 4/1996 | Seto et al. | 439/940 |
| 5,558,540 | 9/1996 | Kato et al. | 439/940 |
| 5,688,133 | 11/1997 | Ikesugi et al. | 439/940 |

*Primary Examiner*—Hien Vu
*Assistant Examiner*—Yong Ki Kim

[57] ABSTRACT

A holding device (10) for gripping a pair of spaced receptacle connectors (50) in a parallel relation, includes a plate-like body (12) having defining two side portions (14) for respectively retaining the two connectors (50) thereto. A retention member (16) is formed on each side portion (14) for grasping two sides of the corresponding connector (50). A pair of guidance channels (22) are provided at two opposite ends of the body (12) for cooperation with the end projections (54) on the connector (50). A pair of bosses (26) are respectively disposed about the corresponding channels (22) for restraining and aligning the lengthwise position of the connector (50) with regard to the holding device (10). Transverse ribs (28) are formed on the body (12) for abutment with the top surface (56) of the connector (50). Therefore, the connector (50) can be reliably and efficiently retained by the holding device (10) for moving to the specific predetermined position on the PC board through a suction nozzle of a robot arm.

12 Claims, 4 Drawing Sheets

HOLDING DEVICE FOR MOUNTING CONNECTOR ON BOARD

BACKGROUND OF THE INVENTION

1. Field of the Invention

The invention relates to the device adapted to cooperate with a suction nozzle for mounting the connector to the PC board, and particularly to the device which can reliably and efficiently hold a pair of connectors for mounting to the PC board.

2. The Related Art

U.S. Pat. No. 5,249,977 discloses a cap detachably attached to a receptacle connector so that such receptacle connector can be picked and displaced, by a suction nozzle, to a specific position on the PC board for a surface mounting soldering. Recently board-to-board connectors are popularly used for interconnecting two parallel spaced PC boards. Understandably, using a pair of connectors respectively disposed on the corresponding boards for mating with each other is not mechanically reliable because these two boards may relatively swing with each other around the lengthwise direction of these two mated connectors. Therefore, to properly and evenly connect these two spaced boards, two connectors are required to be mounted to each board and designedly to be adapted to mate with the corresponding connectors. Under this situation, the connection area between these two boards is substantially a significant rectangular region, not the original single lengthwise region which tends to have the boards vibrate with each other as mentioned before.

U.S. Pat. No. 5,558,540 discloses a duplex connector assembly including a pair of connector units for cooperation with a removable holding means for mounting to a PC board. Generally speaking, it is somewhat complicated and uneasy to mold a unitary connector assembly including two juxtaposed connector units while still precisely controlling the relative positions and dimensions. Thus, some attempts have been made to use a holding device for simultaneously gripping two parallel spaced simplex connectors and mounting to one PC board. It should be noted that different from the holding device for mounting one simplex connector on a PC board as disclosed in U.S. Pat. No. 5,249,977, using one holding device for simultaneously incorporating two juxtaposed simplex connectors requires higher precision and delicate procedure.

Therefore, an object of the invention is to provide a holding device for simultaneously gripping two spaced connectors in a parallel relation for precisely positioning on the corresponding PC board.

SUMMARY OF THE INVENTION

According to an aspect of the invention, a holding device for gripping a pair of spaced receptacle connectors in a parallel relation, includes a plate-like body having defining two side portions for respectively retaining the two connectors thereto. A retention member is formed on each side portion for grasping two sides of the corresponding connector. A pair of guidance channels are provided at two opposite ends of the body for cooperation with the end projections on the connector. A pair of bosses are respectively disposed about the corresponding channels for restraining and aligning the lengthwise position of the connector with regard to the holding device. Transverse ribs are formed on the body for abutment with the top surface of the connector. Therefore, the connector can be reliably and efficiently retained by the holding device for moving to the specific predetermined position on the PC board through a suction nozzle of a robot arm.

DETAILED DESCRIPTION OF THE PREFERRED EMBODIMENTS

Figure 1:
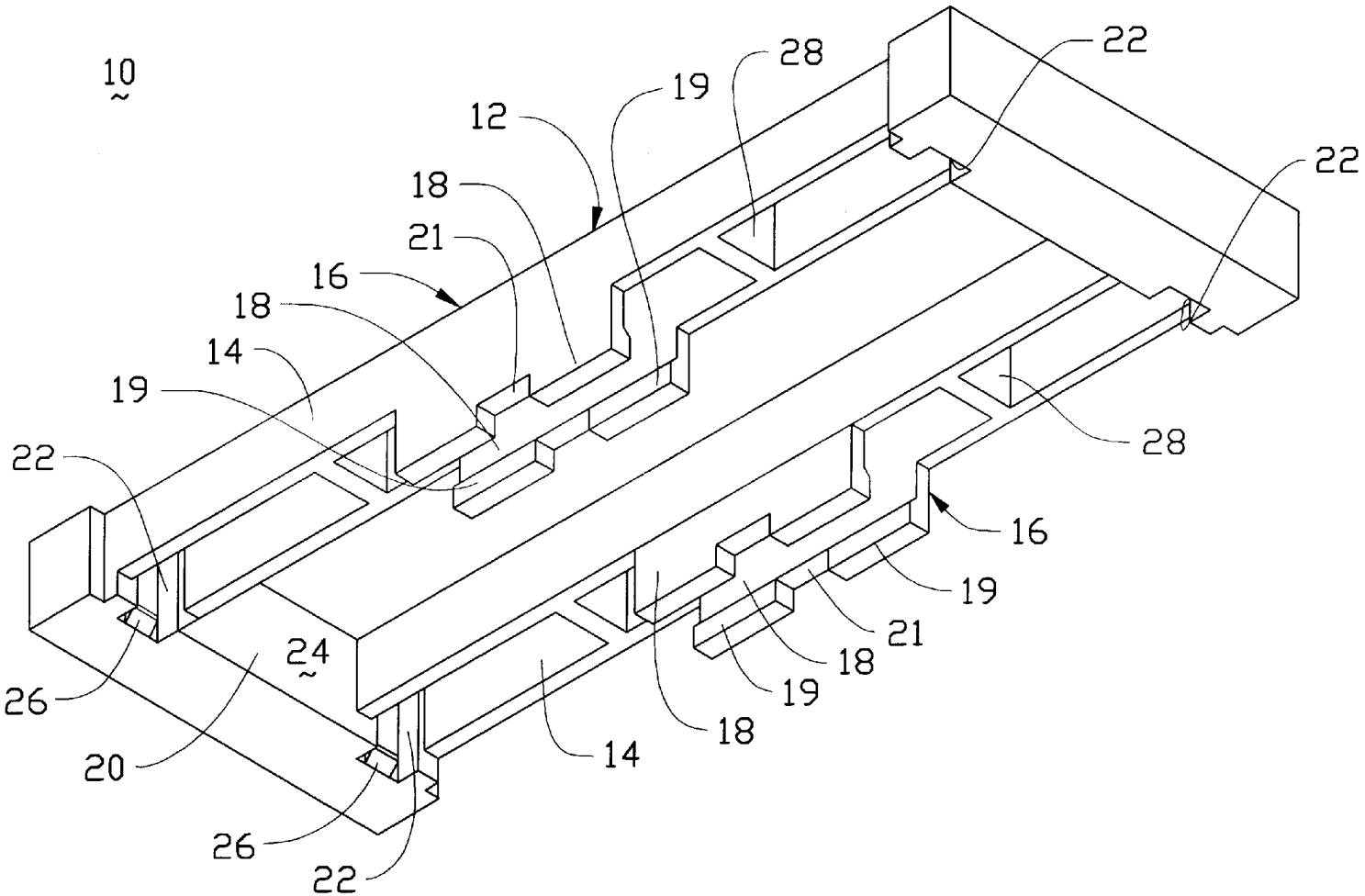
FIG. 1 is a perspective view of a presently preferred embodiment of a holding device for use with a receptacle connector, according to the invention.
Figure 2:
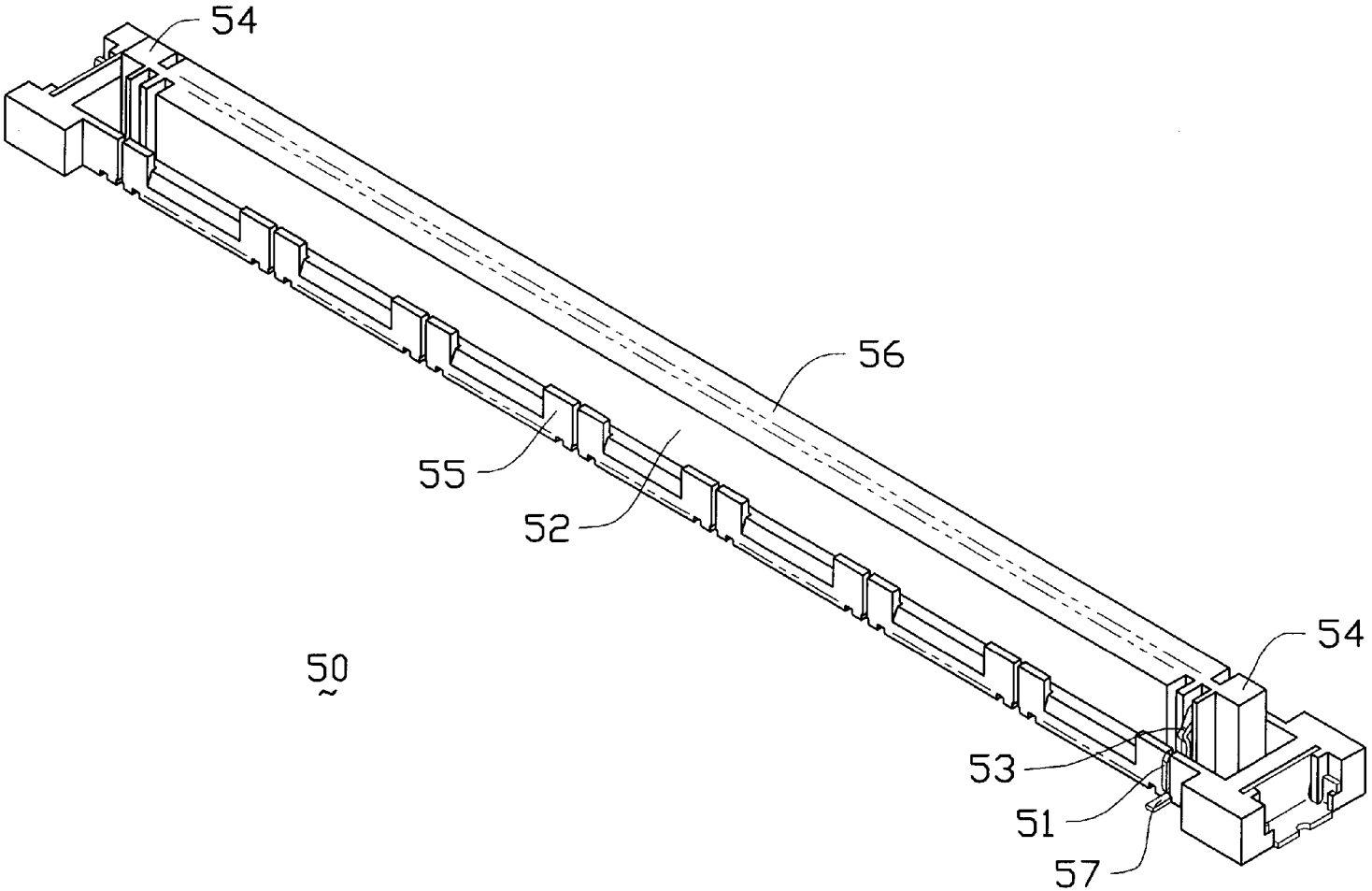
FIG. 2 is a perspective view of a receptacle connector for use with the holding device of FIG. 2.
Figure 3:
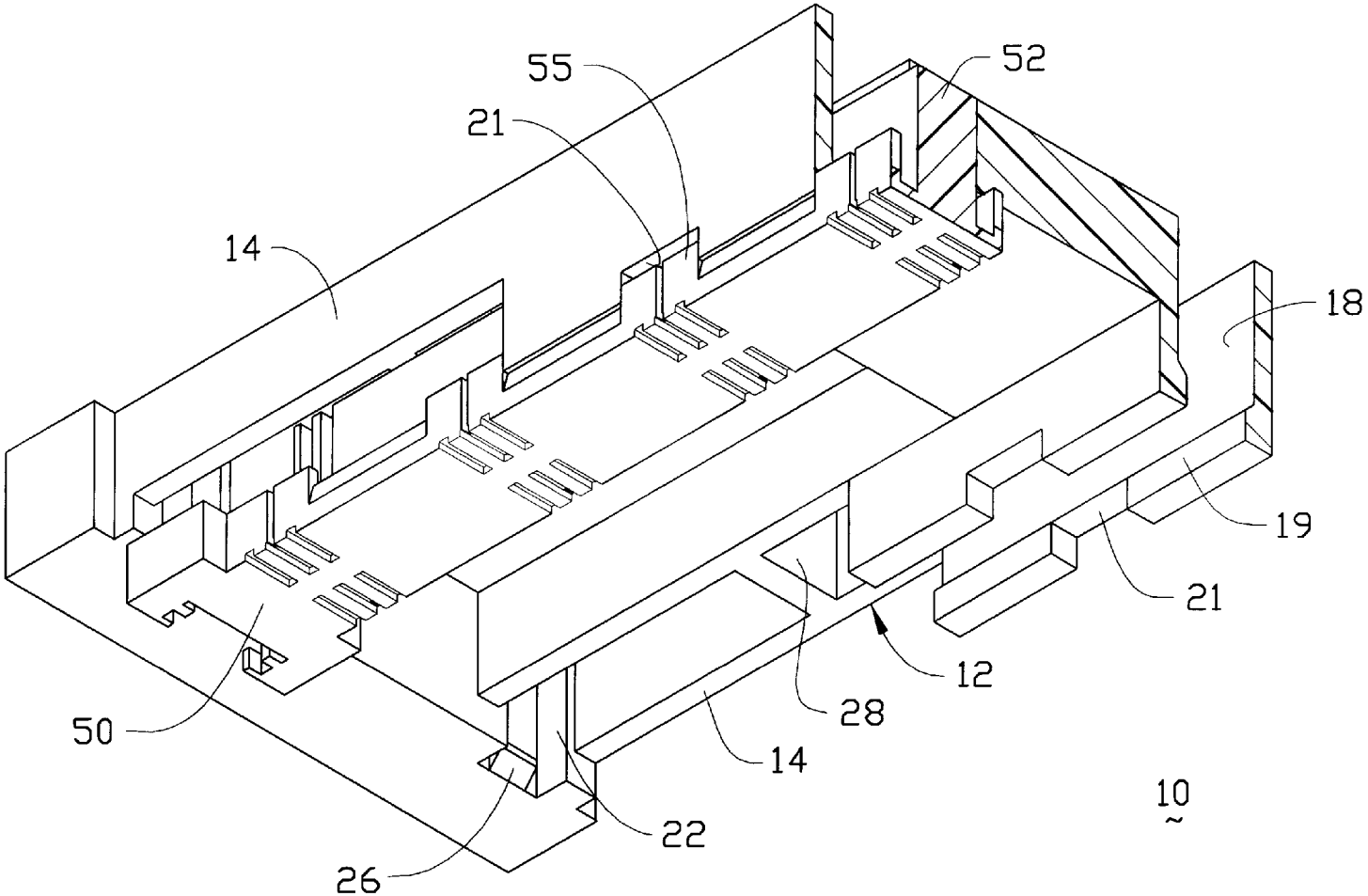
FIG. 3 is an enlarged partial perspective view of the assembled holding device of FIG. 1 and connector of FIG. 2 to show the retention member, the guidance channel and the boss of the holding device and how the connector incorporates the holding device.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–4 wherein a holding device 10 for use with a receptacle connector 50 includes a plate-like body 12 defining two side portions 14.

Each portion 14 includes a retention member 16 composed of a pair of downward extending spring arms 18 defining therebetween a space which is generally compliant with a width of a center raised island 52 of the connector 50. Each spring arm 18 has an expanded head 19 at the tip which can cooperate with the other one of the opposing spring arm 18 for efficiently and reliably retainably sandwiching the center raised island 52 of the connector 50 therebetween. One recess 21 is formed in each spring arm 18 which comply with the corresponding extending vertical walls 55 of the connector 50, so as not to interfere with each other when the connector 50 and the holding device 10 are assembled.

A pair of end walls 20 are formed at two opposite ends of the body 12 wherein two guidance channels 22 are formed on the interior surface 24 of the end wall 20 each for cooperation with the end projection 54 of the island 52 of the connector 50 for guiding insertion of the connector 50 to the holding device 10.

Each channel 22 further includes a boss 26 therein so that those two bosses 26 respectively disposed in the opposite channels 22 may align and properly restrain the elongated connector 50 with regard to the holding device 10 in the lengthwise direction.

A pair of transverse ribs 28 is positioned on each side portion 14 for being adapted to engage the top surface 56 of the island 52 of the connector 50.

When assembled, the connector 50 is attached to the holding device 10 from the bottom wherein the island 52 of the connector 50 may guided by the guidance channel 22 by its end projections 54, and also may engage the retention member 16 of the holding device 10. The connector 50 will upward move toward the holding device 10 until the top surface 56 of the island 52 contacts the ribs 28 of the holding device 10. Under this situation, the connector 50 can be restrained and aligned with regard to the holding device 10 in the lengthwise direction by the bosses 26 in the channels 22 of the holding device 10. At the same time, each spring arm 18 is receivably positioned between two specific corresponding vertical walls 55 wherein the recess 21 of each arm 18 may receive another vertical walls 55 therein for no interference occurring between the arm 18 of the holding device 10 and the vertical wall 55 of the connector 50. The spring arms 18 of the retention member 16 provides not only a retention function but also an alignment function between the holding device 10 and the connector 50. Therefore, the whole assembly including the holding device 10 and the connector 50 can be moved by a suction nozzle and placed on a specific region of a PC board (not shown) wherein the contact tails 57 of the connectors 50 can be surface mounted to the PC board, and mounting ears of the connector 50 are also able to be soldered to the PC board.

Even though in this embodiment only one connector 50 is used with the holding device 10, it should be understood that two spaced connectors 50 may be used with the holding device 10 for being simultaneously and precisely positioned on the PC board for surface mounting.

Figure 4:
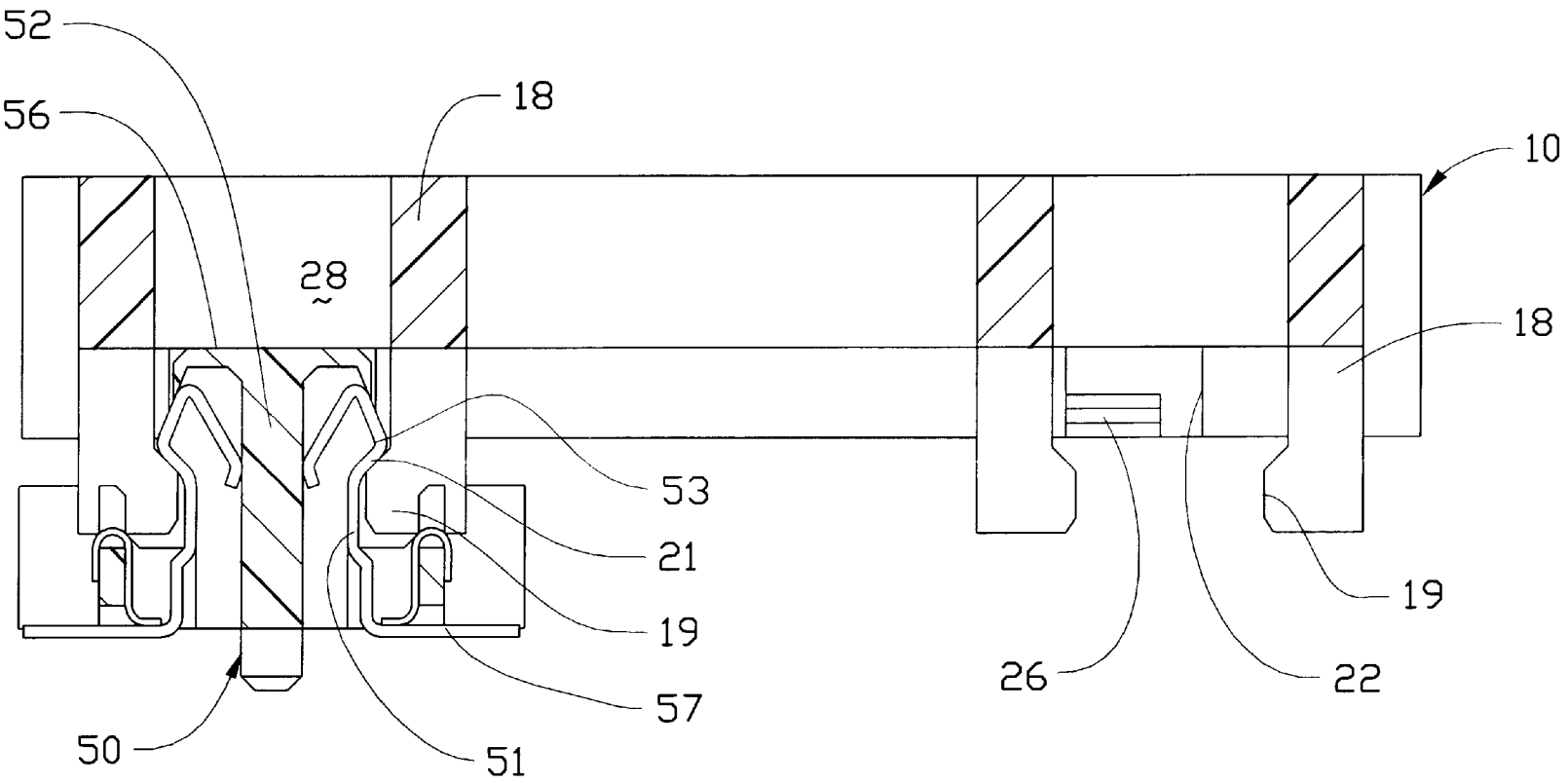
FIG. 4 is a cross-sectional view of the assembled holding device and connector of FIG. 3 to show how the retention member retainably engages the center raised island of the connector.

It is noted that as shown in FIG. 4, when assembled, the convex engagement sections 53 of the contacts 51 of the connector 50 can be engaged with the inner tapered surfaces 21 of the expanded heads 19 of the arms 18, so as to provide additional retention for the assembly of the holding device 10 and the connector 50.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A holding device for use with a connector, comprising:

a plate-like body;

at least a retention member disposed on the body for retaining two sides of the connector;

a pair of end walls downward extending from two opposite end of the body;

a pair of guidance channels positioned in the end walls for cooperative engagement with end projections of the connector, wherein a boss is disposed in each of said channels for providing a lengthwise alignment function.

2. The holding device as defined in claim 1, wherein the body includes ribs for providing stopper surfaces thereon so as to engage a top surface of the connector.

3. The holding device as defined in claim 1, wherein the retention member comprises a pair of spring arms, of which each has an expanded head at its tip.

4. The holding device as defined in claim 3, wherein each spring arms further includes at least one recess along a lower edge portion for compliantly receiving a corresponding vertical side wall of the connector.

5. A connector assembly for combining a connector and a holding device together, comprising:

a retention member downward extending from a main body of the holding device for retainably engaging two sides of a center island of the connector; wherein a pair of channels are formed adjacent two opposite ends of the holding device for guidably receiving end projections of the center island of the connector therein and a boss is formed within each of said channels.

6. The connector assembly as defined in claim 5, wherein transverse ribs are provided as stopper means for engagement with a top surface of the center island of the connector.

7. The connector assembly as defined in claim 5, wherein the retention member includes a pair of spring arms.

8. The connector assembly as defined in claim 7, wherein each of said arms has an expanded head, an interior surface of which compliantly engages with convex engagement sections of contacts of the connector.

9. The connector assembly as defined in claim 7, wherein the connector includes a plurality of vertical side walls and each of said spring arms is dimensioned to be disposed between two specific vertical side walls.

10. The connector assembly as defined in claim 8, wherein each of the spring arms further includes at least a recess for receiving other vertical side walls positioned between said two specific side walls.

11. An electrical assembly comprising:

a holding device having a plat-like main body defining two side portions for respectively receiving a pair of spaced connectors therein;

a pair of spring arms downward extending from the main body and defining a space therebetween;

at least a receptacle connector positioned in one of said side portions of the body, and defining thereof a center raised island wherein a width of said island is generally equal to said space, so that the connector can be retained with regard to the holding device through an expanded head of each arm engaging either side of the island of the connector; wherein each of said spring arms is received in a space defined between two specific vertical side walls of the connector and wherein each of said spring arms further includes recesses for respectively receiving corresponding vertical side walls between said two specific vertical side walls.

12. A holding device for use with a connector, comprising:

a plate-like body;

at least a retention member disposed on the body for retaining two sides of the connector;

a pair of end walls downward extending from two opposite end of the body;

a pair of guidance channels positioned in the end walls for cooperative engagement with end projections of the connector; wherein the retention member comprises a pair of spring arms, of which each has an expanded head at its tip, and wherein each spring arms further includes at least one recess along a lower edge portion for compliantly receiving a corresponding vertical side wall of the connector.

* * * * *